US009777745B2

(12) United States Patent
Zhao et al.

(10) Patent No.: US 9,777,745 B2
(45) Date of Patent: Oct. 3, 2017

(54) PUMP HOUSING AND DRAINAGE PUMP

(75) Inventors: Zheng Zhao, Shenzhen (CN); Kin Wah Wong, Hong Kong (CN); Min Li, Shenzhen (CN)

(73) Assignee: Johnson Electric S.A., Murten (CH)

( * ) Notice: Subject to any disclaimer, the term of this patent is extended or adjusted under 35 U.S.C. 154(b) by 814 days.

(21) Appl. No.: 13/304,002

(22) Filed: Nov. 23, 2011

(65) Prior Publication Data

US 2012/0134796 A1 May 31, 2012

(30) Foreign Application Priority Data

Nov. 26, 2010 (CN) ..... 2010 1 0561615

(51) Int. Cl.
*F04D 29/40* (2006.01)
*F04D 29/42* (2006.01)
*F04D 29/44* (2006.01)

(52) U.S. Cl.
CPC ..... *F04D 29/426* (2013.01); *F04D 29/445* (2013.01); *F05D 2250/61* (2013.01)

(58) Field of Classification Search
CPC ..... F04D 29/445; F04D 29/426
USPC ..... 415/203, 204, 205, 206, 208.1, 208.2, 415/212.1, 182.1, 183, 184, 224, 224.5; 417/423.1, 423.14
See application file for complete search history.

(56) References Cited

U.S. PATENT DOCUMENTS 3,402,669 A * 9/1968 Mamo ..... 415/26
4,448,573 A * 5/1984 Franz ..... 415/206
5,399,068 A * 3/1995 Park ..... F04D 29/444 415/204
5,967,747 A * 10/1999 Burke et al. ..... 415/206
6,264,441 B1 * 7/2001 Marioni ..... 417/423.1
6,715,994 B2 * 4/2004 Patel et al. ..... 417/12
6,863,496 B2 * 3/2005 Cho ..... F04D 29/667 415/173.5
7,066,715 B2 * 6/2006 Martin et al. ..... 415/203
7,517,185 B2 * 4/2009 Hirakawa ..... F04D 17/04 415/119
2003/0072656 A1 * 4/2003 Niwatsukino et al. ..... 417/354
2006/0216147 A1 * 9/2006 Park ..... 415/220
2008/0056885 A1 * 3/2008 Hablanian ..... 415/90
2011/0027076 A1 * 2/2011 Alison-Youel ..... 415/185

FOREIGN PATENT DOCUMENTS

CN 201473784 U 5/2010

OTHER PUBLICATIONS

Volute_Pump_(Wikipedia; Sep. 26, 2014) http://en.wikipedia.org/wiki/Volute_(pump).*

* cited by examiner

*Primary Examiner* — Justin Seabe
(74) *Attorney, Agent, or Firm* — Muncy. Geissler, Olds & Lowe, P.C.

(57) ABSTRACT

A drainage pump has an impeller, a motor for driving the impeller, and a pump housing surrounding the impeller. The pump housing has an end wall, a side wall, an inlet, and an outlet. The side wall extends from the end wall. The side wall and the end wall cooperatively define a pump chamber. The inner surface of the side wall has at least one interfering surface for mixing of fluid flowing through the pump housing.

11 Claims, 3 Drawing Sheets

PUMP HOUSING AND DRAINAGE PUMP

CROSS REFERENCE TO RELATED APPLICATIONS

This non-provisional patent application claims priority under 35 U.S.C. §119(a) from Patent Application No. 201010561615.3 filed in The People's Republic of China on Nov. 26, 2010.

FIELD OF THE INVENTION

This invention relates to pumps and, in particular, to a pump housing for use in drainage pumps of domestic appliances such as washing machines and the like.

BACKGROUND OF THE INVENTION

In operation, drainage pumps used in appliances, such as washing machines or dish washers, usually go through a full water phase, where the pump housing of the drainage pump is full of a liquid such as water, and a fluid or air/water phase, where the water in the pump housing is mixed with air. During the air/water phase, air is sucked into the drainage pump, producing an increase in the noise created by the pump.

Traditional pump housings have a smooth inner surface. It is thought that this smooth surface allows for a relatively smooth flow of the fluid within the pump housing or pump chamber, allowing the air/water mixture to contain large bubbles or pockets of air. It is thought that these air pockets are responsible for producing an irritating noise of varying frequency or pitch which is emitted by the drainage pump during the air water phase. This noise is referred to herein as an intermittent noise due to its perceived variability although in fact it may not be truly intermittent.

SUMMARY OF THE INVENTION

The present invention aims to provide a new pump housing and a new drainage pump using same which can solve, or at least reduce, the above mentioned problem. This is achieved by providing the pump housing with an inner surface which is purposely not smooth so as to create a turbulent mixing of the air and water during the air/water phase which is thought to produce an air/water mixture in which the air is predominately in small bubbles thereby generating a noise of a substantially constant range of frequencies or pitch from the pump. This is commonly referred to as improving the quality of the noise produced by the pump.

Accordingly, in one aspect thereof, the present invention provides a drainage pump, comprising: a motor defining a motor axis; an impeller driven by the motor; a pump housing surrounding the impeller; and a bracket connecting the pump housing to the motor, wherein the pump housing comprises: an end wall extending perpendicularly to the motor axis; a side wall extending from the end wall and having an inner surface, the side wall, the end wall and the bracket cooperatively defining a pump chamber; and an inlet and an outlet both communicating with the pump chamber; and wherein the inner surface of the side wall comprises at least one interfering surface for creating mixing of fluid flowing through the pump housing.

Preferably, the at least one interfering surface comprises at least one concave surface formed by at least one slot or recess in the side wall.

Preferably, the at least one interfering surface is formed by at least one slot in the side wall, the at least one slot extending in a direction that is non-parallel to the end wall.

Preferably, the at least one interfering surface is formed by at least one slot in the side wall, the at least one slot extends in a direction substantially parallel to the motor axis.

Preferably, the at least one interfering surface is formed by at least one protrusion on the inner surface of the side wall.

Preferably, the protrusion is hemispheric, partly spherical, cone-shaped, pyramid-shaped, or wedge-shaped.

Preferably, the protrusion is integrally formed with the side wall.

Preferably, the at least one interfering surface comprises a plurality of interfering surfaces that are arranged at positions that are spaced in a direction along the motor axis.

Preferably, the at least one interfering surface comprises at least one concave surface formed by a slot or recess in the inner surface of the side wall and at least one convex surface formed by a projection on the inner surface of the side wall.

Preferably, the at least one interfering surface comprises a plurality of interfering surfaces arranged at regular angular intervals along the circumferential direction of the inner surface of the side wall.

Preferably, the at least one interfering surface comprises a plurality of interfering surfaces that are arranged at one of at least two different positions that are spaced in a direction along the motor axis and wherein the interfering surfaces are formed by projections and/or recesses.

According to a second aspect, the present invention provides a pump housing, comprising: an end wall; a side wall extending from the end wall, the side wall and the end wall cooperatively defining a pump chamber; and an inlet and an outlet both communicating with the pump chamber; wherein an inner surface of the side wall comprises at least one interfering surface for creating mixing of fluid flowing through the pump housing.

In embodiments of the present invention, the pump housing produces a noise having a relatively consistent sound or frequency. Compared to the intermittent noise, this constant noise is easier to accept due to its perceived better sound quality, even though the actual volume or loudness of the noise may be substantially similar.

BRIEF DESCRIPTION OF THE DRAWINGS

Preferred embodiments of the invention will now be described, by way of example only, with reference to figures of the accompanying drawings. In the figures, identical structures, elements or parts that appear in more than one figure are generally labelled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
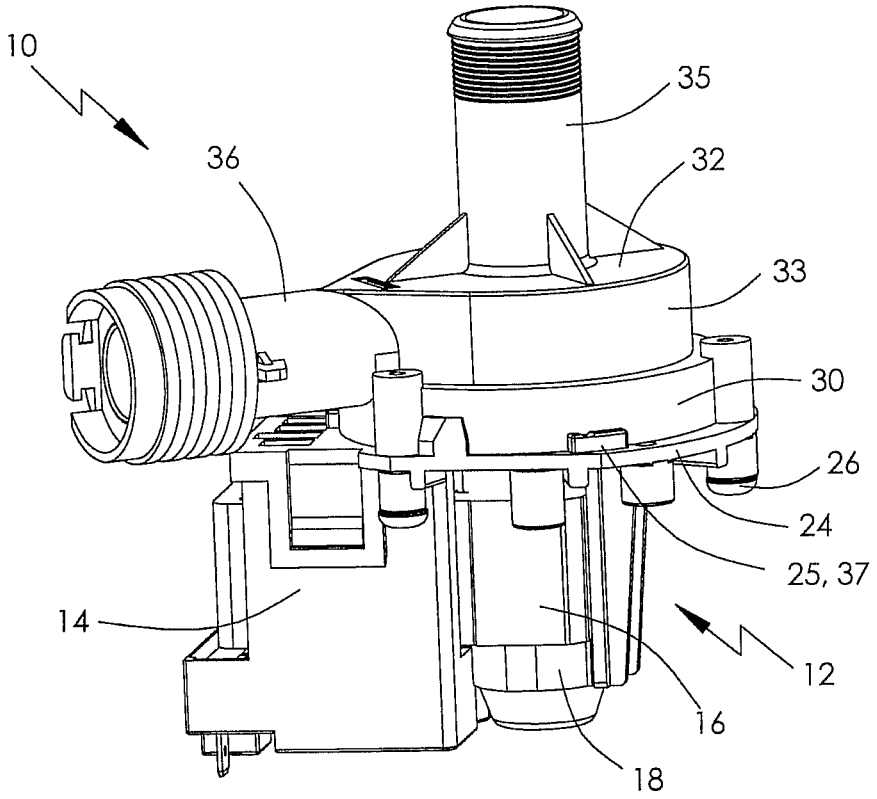
FIG. 1 illustrates a drainage pump, according to a first embodiment of the present invention.
Figure 2:
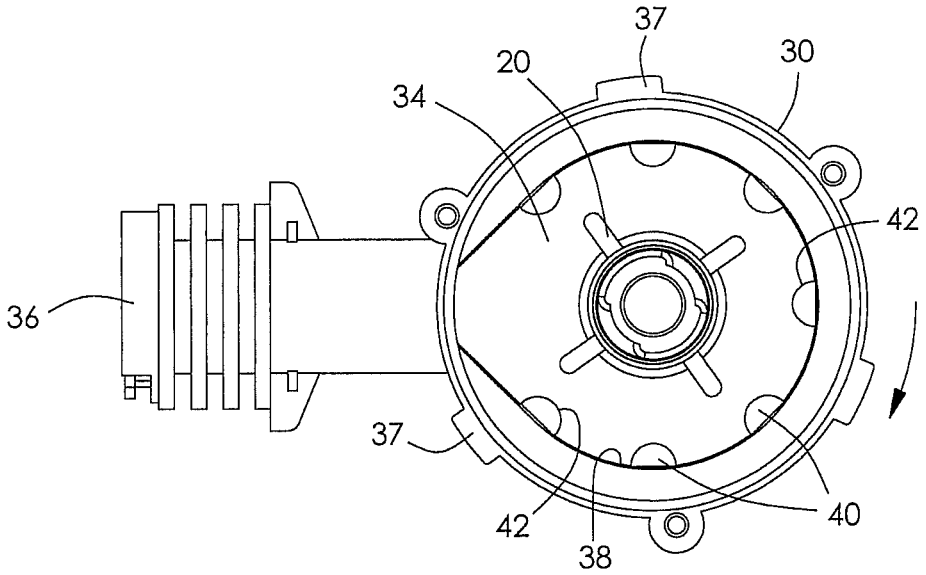
FIG. 2 is a view from below of a pump housing and an impeller, being parts of the pump of FIG. 1.
Figure 3:
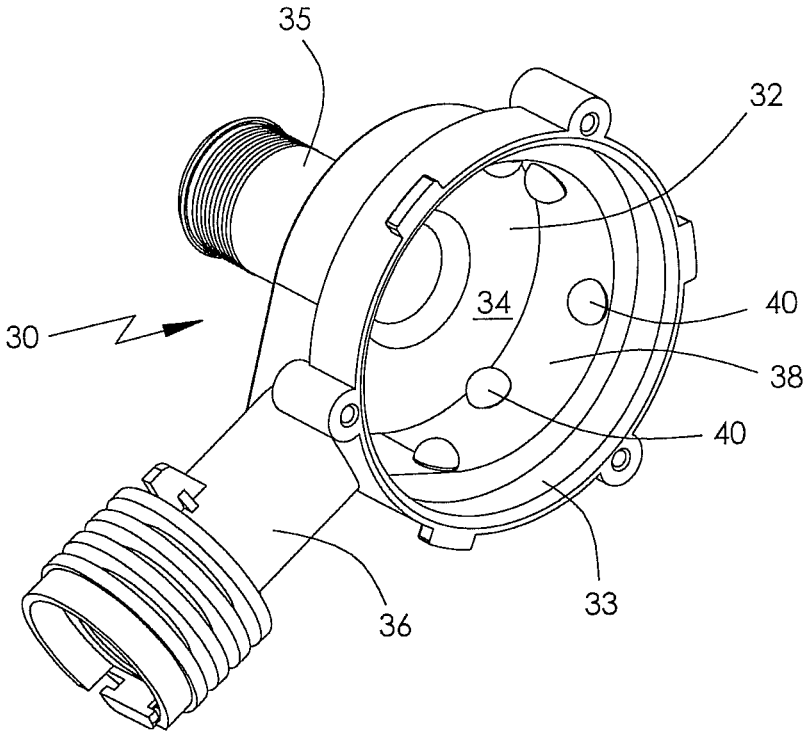
FIG. 3 is an isometric view of the pump housing of FIG. 2, viewed from a different angle.

A first preferred embodiment of a drainage pump is shown in FIGS. 1 to 3. The pump 10 includes a motor 12, a pump housing 30 connected to the motor 12 to form a pump chamber, and an impeller 20 driven by the motor 12 and disposed within the pump chamber.

The motor 12 defines a motor axis (not shown) about which a rotor (not shown) rotates. The motor has a stator 14 and a bracket 24. The rotor magnetically couples with the stator 14 so as to be rotated by the stator and is journalled in bearings. The bracket 24 is connected to the stator 14, forming a part of a stator housing and with the pump housing completes the pump chamber. While the bracket may have a through hole for a shaft of the rotor to run through, which then requires a seal between the bracket 24 and the shaft, to prevent leakage of liquid from the pump, the motor illustrated and preferred has a wet rotor design as typically used in small appliance drainage pumps. In the wet rotor design, the bracket forms a thin walled pocket or envelope 18 in which the rotor and rotor bearings are disposed thus fully sealing the pump chamber from the rest of the motor. The stator poles formed by the stator core 16 magnetically interact with the rotor through the wall of the envelope 18.

The pump housing 30 has a circular end wall 32, a tubular side wall 33, an inlet 35, and an outlet 36. The side wall 33 extends perpendicularly from the end wall 32, in the axial the direction of the motor axis, and is sealed to the bracket 24, thereby defining the pump chamber 34 for the impeller 20 and fluid. The inlet 35 extends outwardly from the end wall 32. The outlet 36 extends outwardly from the side wall 33 in a direction generally perpendicular to the motor axis. The inlet 35 and the outlet 36 connect the pump chamber 34 to the outside. The pump housing has locating tabs 37 which locate by a twisting action into detents 25 formed on the bracket 24. The pump housing is further secured to the bracket by screws 26.

Figure 4:
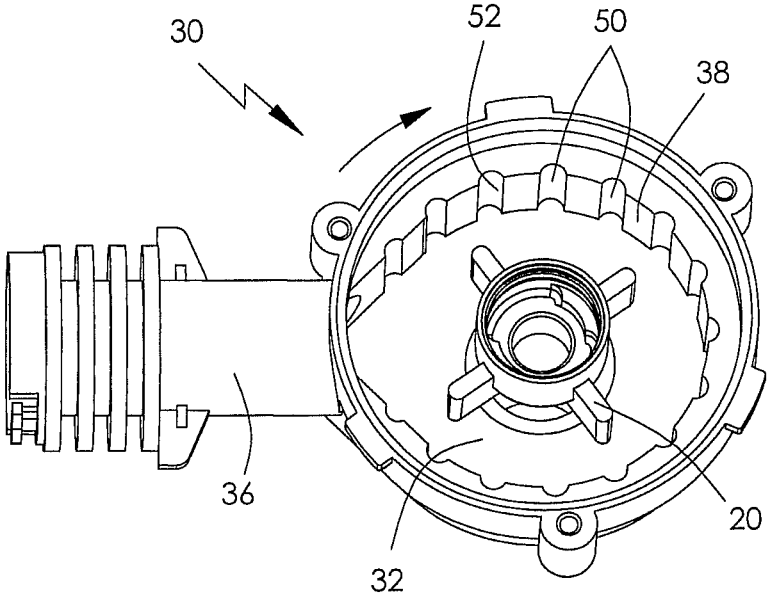
FIG. 4 is an inside view of a pump housing and an impeller, according to a second embodiment of the present invention.

The side wall 33 includes an inner surface 38 that partially surrounds the pump chamber 34. The inner surface 38 includes a number of interfering surfaces 42, 52 (FIGS. 2 and 4). The interfering surfaces 42, 52 are arranged to break up the fluid flowing into the pump housing 30 via the inlet 35 during the air/water phase. That is, the interfering surfaces provide an abrupt change in the surface of the inner wall, causing the fluid to be abruptly deflected creating greater turbulence or mixing of the fluid in the pump chamber to finely disperse the air throughout the water As such, the finely mixed air and water provide a constant load on the impeller 20, whereby the noise created by the pump sounds continuous or constant rather than intermittent. Compared to the intermittent noise produced by traditional pump housings, this constant noise has a relatively consistent frequency or better sound quality and is easier to accept. Also, the interfering surfaces 42, 52 change the flow path of the fluid through the pump chamber and reduces the impact that the fluid has on the pump housing 30.

Referring especially to FIG. 2, in a first embodiment of the present invention, the pump housing 30 includes a number of protrusions 40 protruding inwardly from the inner surface 38. The protrusions 40 may be integrally formed with the side wall 33. Each protrusion 40 is substantially hemispheric or at least partly spherical, and the surface thereof constitutes the interfering surface 42. The interfering surface 42 faces substantially to the flow direction (shown by the arrow) of the fluid in the pump chamber 34. The protrusions 40 are preferably arranged at regular angular intervals along the circumferential direction of the inner surface 38. As shown in FIG. 3, the protrusions 40 are preferably centered in different planes spaced in the direction of the motor axis. Optionally, the protrusions are alternately centered on one of two axially spaced planes.

It should be understood that the shape of the protrusions 40 is not limited to a hemisphere. For example, in other embodiments, the protrusion 40 may be substantially cone-shaped, pyramid-shaped, or wedge-shaped, while the interfering surface 42 is respectively curved/arc-shaped, planar/triangular, or planar/rectangular.

According to a second embodiment of the present invention, as shown in FIG. 4, the pump housing 30 has a number of slots 50 in the inner surface 38, extending in the direction of the motor axis. The slots 50 are preferably arranged at regular angular intervals along the circumferential direction of the inner surface 38. A portion of the inner surface of each slot constitutes the interfering surface 52. The interfering surface 52 substantially faces the flow direction (shown by the arrow) of the fluid in the pump chamber 34.

Figure 5:
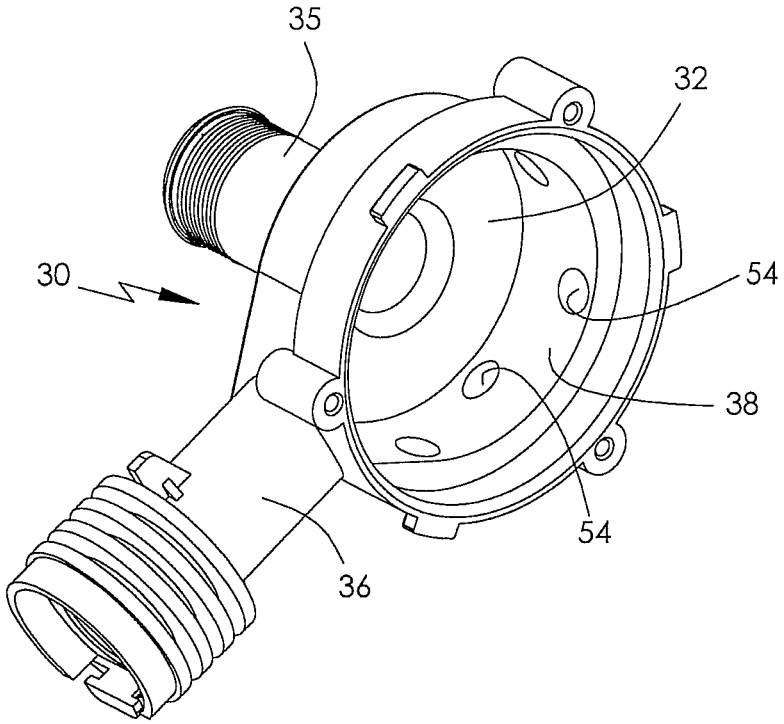
FIG. 5 is an inside view of a pump housing, according to a third embodiment of the present invention.

It should be understood that when the extending direction of the slots 50 is non-perpendicular to the motor axis, the interfering surface 52 can still perform the function of breaking up or mixing the fluid flowing through the pump housing 30. Therefore, the extending direction of each slot 50 is not limited to being parallel to the motor axis. It should also be understood that the slots 50 can be recesses such as the recesses 54 in the pump housing 30 of FIG. 5, where a part of the inner surface of each recess 54 forms the interfering surface 52.

Figure 6:
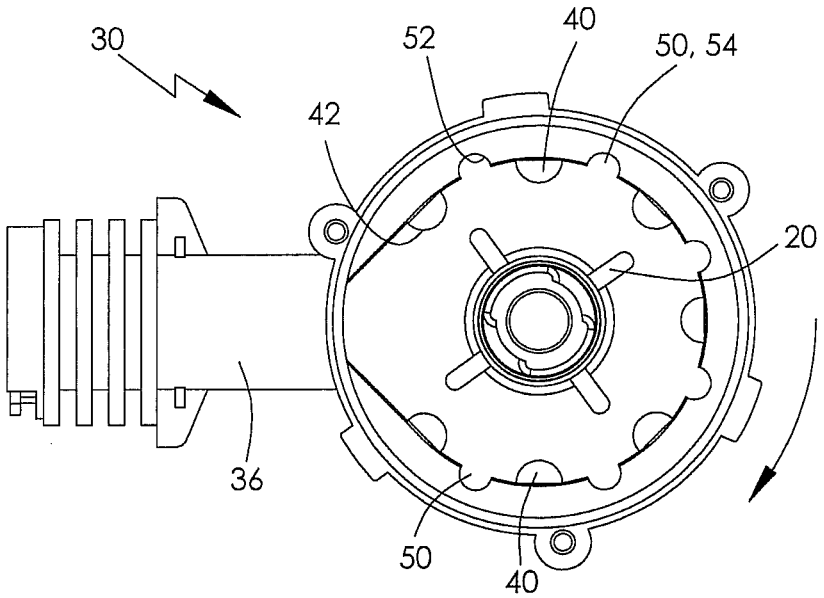
FIG. 6 is an inside view of a pump housing, according to another embodiment of the present invention.

In another embodiment, as shown in FIG. 6, the inner surface 38 of the pump housing 30 has convex interfering surfaces like interfering surface 42, and concave interfering surfaces like interfering surface 52. That is, it has both projections 40 and slots 50 or recesses 54. In other embodiments, the pump housing 30 has just convex interfering surfaces 42 or concave interfering surfaces 52. It should be understood that the positions of the inlet 35 and outlet 36 are not limited to the positions shown.

In the examples shown, the motor is a permanent magnet synchronous motor which may run in either direction, so the projections, slots and recesses are symmetrical to provide similar interfering surfaces regardless in which direction the motor runs. For a pump which can operate in only one direction, the projections, slots and recesses need not be symmetrical, as long as the interfering surfaces are arranged such that the fluid impinges on the interfering surfaces.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A drainage pump, comprising:

an end wall;

a side wall extending from the end wall and cooperatively defining a pump chamber with the end wall;

an impeller arranged inside the pump chamber; and an inlet extending outwardly from the end wall, and an outlet extending outwardly from the side wall, the inlet and the outlet both communicating with the pump chamber;

wherein semicylindrical slots as interfering surfaces are formed on an inner surface of the side wall that surrounds the impeller, a longitudinal direction of the semicylindrical slots extend in a direction parallel to the impeller axis, for creating a turbulent mixing of the air and water during the air water phase and improving the quality of the noise produced by the pump, and the inner surface of the side wall between two adjacent ones of the interfering surfaces are substantially flat or parallel to a circumferential direction of the side wall.

2. The drainage pump of claim 1, wherein the semicylindrical slots are located upstream of the outlet and radially facing to the impeller.

3. The drainage pump of claim 1, wherein the semicylindrical slots comprise recesses in the inner surface of the side wall.

4. The drainage pump of claim 1, wherein the number of the semicylindrical slots is greater than the number of blades of the impeller.

5. The drainage pump of claim 1, wherein every two adjacent semicylindrical slots are circumferentially spaced.

6. A drainage pump, comprising:

a motor defining a motor axis;

an impeller driven by the motor;

a pump housing surrounding the impeller; and a bracket connecting the pump housing to the motor, wherein the pump housing comprises: an end wall extending perpendicularly to the motor axis; a side wall extending from the end wall and having an inner surface, the side wall, the end wall and the bracket cooperatively defining a pump chamber; and an inlet and an outlet both communicating with the pump chamber; and wherein semicylindrical slots as interfering surfaces are formed on an inner surface of the side wall that surrounds the impeller, a longitudinal direction of the semicylindrical slots extend in a direction parallel to the impeller axis, for creating a turbulent mixing of the air and water during the air water phase and improving the quality of the noise produced by the pump, and the inner surface of the side wall between two adjacent ones of the interfering surfaces are substantially flat or parallel to a circumferential direction of the side wall.

7. The drainage pump of claim 6, wherein the semicylindrical slots are located upstream of the outlet and radially facing to the impeller.

8. The drainage pump of claim 6, wherein the semicylindrical slots comprise recesses in the inner surface of the side wall.

9. The drainage pump of claim 6, wherein the number of semicylindrical slots is greater than the number of blades of the impeller.

10. The drainage pump of claim 6, wherein every two adjacent semicylindrical slots are circumferentially spaced.

11. The drainage pump of claim 10, wherein the side wall being sealed to the bracket and cooperatively defining the pump chamber with the end wall and the bracket.

* * * * *